United States Patent [19]

Nishimiya et al.

[11] 4,019,474

[45] Apr. 26, 1977

[54] AIR-FUEL RATIO REGULATING APPARATUS FOR AN INTERNAL COMBUSTION ENGINE WITH EXHAUST GAS SENSOR CHARACTERISTIC COMPENSATION

[75] Inventors: Torazo Nishimiya, Mito; Takao Sasayama, Hitachi, both of Japan

[73] Assignee: Hitachi, Ltd., Japan

[22] Filed: Oct. 30, 1975

[21] Appl. No.: 627,370

[30] Foreign Application Priority Data

Nov. 1, 1974 Japan ..... 49-125454

[52] U.S. Cl. ..... 123/32 EE; 60/276

[51] Int. Cl.[2] ..... F02B 3/00

[58] Field of Search ..... 123/32 EE, 32 EA; 60/276, 285

[56] References Cited

UNITED STATES PATENTS

| | | | |
|---|---|---|---|
| 3,815,561 | 6/1974 | Seitz | 60/276 |
| 3,851,469 | 12/1974 | Eichler et al. | 60/285 |
| 3,903,853 | 9/1975 | Kizler et al. | 123/32 EA |
| 3,919,983 | 11/1975 | Wahl et al. | 123/32 EA |
| 3,938,075 | 2/1976 | Reddy | 60/285 |
| 3,973,529 | 10/1976 | Wessel et al. | 123/32 EA |

*Primary Examiner*—C. J. Husar
*Assistant Examiner*—Paul Devinsky
*Attorney, Agent, or Firm*—Craig & Antonelli

[57] ABSTRACT

An apparatus which comprises a detector for detecting the density of one component (oxygen, for example) of exhaust gases from an internal combustion engine for regulating the ratio of air to fuel based on the detected value of the component in such a manner that the air-fuel ratio can be made approximate to the theoretical air-fuel ratio. The apparatus further comprises a first comparator having a hysteresis range and a second comparator having no hysteresis range for detecting the output of the detector for detecting the density of one component of exhaust gases, in order that variations in the characteristics of the detector or changes in its characteristics with time can be compensated for.

3 Claims, 5 Drawing Figures

| | REGION | 1 | 2 | 3 | 4 |
|---|---|---|---|---|---|
| WHEN VOLTAGE $V_O$ RISES | FIRST COMPARATOR | L | L | L | H |
| | SECOND COMPARATOR | L | L | H | H |
| | AND GATE | L | L | L | H |
| WHEN VOLTAGE $V_O$ FALLS | FIRST COMPARATOR | L | H | H | H |
| | SECOND COMPARATOR | L | L | H | H |
| | AND GATE | L | L | H | H |

HYSTERESIS RANGE OF COMPARATOR

AIR-FUEL RATIO REGULATING APPARATUS FOR AN INTERNAL COMBUSTION ENGINE WITH EXHAUST GAS SENSOR CHARACTERISTIC COMPENSATION

BACKGROUND OF THE INVENTION

This invention relates to air-fuel ratio regulating apparatus for regulating the ratio of air to fuel of a fuel-air mixture supplied to internal combustion engines, and more particularly to an air-fuel ratio regulating apparatus which is adapted to automatically regulate the air-fuel ratio of a fuel-air mixture supplied to an internal combustion engine for a motor vehicle or the like in order to reduce the amounts of toxic components of exhaust gases.

The systems which have hitherto been proposed as means for effecting control of exhaust emissions of motor vehicle engines can be broadly classified into the following three types: a first type which uses means for effecting control in the suction system, a second type which uses means for effecting control in the exhaust system and a third type which relies on providing improvements in the combustion of a fuel-air mixture itself. Meanwhile the amounts of hydrocarbons, carbon monoxide and oxides of nitrogen in exhaust gases depend to a large extent on the air-fuel ratio of a fuel-air mixture supplied to the combustion chamber. If it is possible to automatically and positively regulate the air-fuel ratio, the accuracy with which the aforesaid exhaust emisson control means are required to perform will be greatly lowered and the exhaust emission control means can be done without in some cases. In the prior art, the system from the supply of fuel to the engine to venting of exhausts therefrom constitutes an open loop. Thus, the prior art systems of exhaust emission control have the disadvantage of being unable to achieve excellent results as expected in terms of the cost of production, unless the accuracy of performance of each device is increased as much as possible.

Thus, it can be foreseen that, if it is possible to automatically regulate the air-fuel ratio of fuel-air mixtures supplied to the combustion chamber based on the value of one component of exhaust gases which is detected, the burden borne by each exhaust emission control means will decrease and the end of cleaning the exhaust gases can be attained at low cost.

With this point in view, proposals have hitherto been made to use a fuel supply device relying on the feedback system. The present state of art is such, however, that these proposals involve the use of complex circuitry and no satisfactory results can be achieved in spite of the use of such circuitry.

Of the proposals made so far, a proposal which has the highest possibility of being able to be put to practical use concerns a method wherein the oxygen in exhaust gases is detected by an oxygen detector element ($O_2$ sensor) and the air-fuel ratio of an fuel-air mixture supplied by the carburetor is regulated by the output of this element to be approximate to the theoretical air-fuel ratio, so that the oxidizing catalyst device mounted in the exhaust system can operate with a highest conversion rate and exhaust emissions can be controlled satisfactorily to avoid the problem of air polution. Some disadvantages are associated with this method. The control circuit used for this method is complex in construction, and the control of the air-fuel ratio may go away due to a disturbance because such control is basically a proportional control. Particularly, the fundamental drawback is that there is a variation in the results obtained by regulating the air-fuel ratio owing to variations in the characteristics of $O_2$ sensors caused by changes with time or variations in characteristics from one $O_2$ sensor to another. Thus, it is necessary to increase the accuracy with which other exhaust emission control devices are required to perform by taking variations in the characteristics of the $O_2$ sensors and their deterioration into consideration. This results in a marked reduction in the durability and reliability of these exhaust emission control devices, thereby causing an increase in cost which might otherwise be avoided.

SUMMARY OF THE INVENTION

An object of this invention is to provide an air-fuel ratio regulating apparatus wherein the air-fuel ratio of an fuel-air mixture supplied to an internal combustion engine can be automatically controlled by using a circuit of a simple construction in such a manner that the ratio can be made to approximate the theoretical air-fuel ratio (excess air ratio $\lambda = 1.0$), whereby exhaust gases can be reduced in amount.

Another object of the invention is to provide an air-fuel ratio regulating apparatus which is high in response and accuracy of performance.

Another object of the invention is to provide an air-fuel ratio regulating apparatus comprising a control circuit which has hysteresis characteristics so as to compensate for changes in the detector for detecting a component of exhaust gases and variations in characteristics from one detector to another, whereby exhaust emissions can be controlled with increased accuracy.

In the present invention, one component of exhaust gases of the internal combustion engine is detected by the detector and the air-fuel ratio of an fuel-air mixture supplied to the combustion chamber is automatically controlled by the output of such detector so that the ratio may be made to approximate the theoretical air-fuel ratio, whereby the amounts of hydrocarbons, carbon monoxide and oxides of nitrogen can be reduced with an increased degree of efficiency. The invention uses the combination of a first comparator having hysteresis and a second comparator having no hysteresis for detecting the output of the detector for detecting one component of exhaust gases. By using the first and second comparators in combination, it is possible to move the upper limit and the lower limit of the hysteresis range independently of each other.

DESCRIPTION OF A PREFERRED EMBODIMENT

Figure 1:
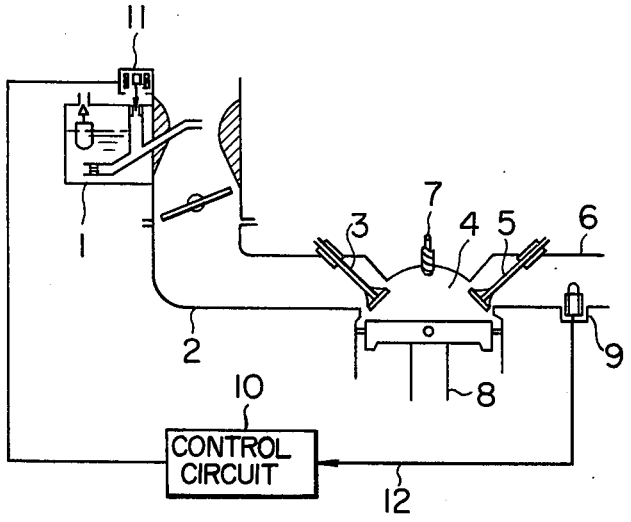
FIG. 1 is a diagrammatic view of the air-fuel ratio regulating apparatus comprising one embodiment of the invention.

In FIG. 1, the numeral 1 is a fuel supply device, such as carburetor, 2 a suction pipe, 3 a suction valve, 4 a combustion chamber, 5 an exhaust valve, 6 an exhaust pipe, 7 an ignition plug, 8 a piston, 9 an exhaust gas detector, such as $O_2$ sensor, mounted in the exhaust pipe 6, 10 a control circuit, 11 an electromagnetic valve for regulating the air-fuel ratio of a fuel-air mixture supplied by the fuel supply device 1, and 12 a feedback system.

Figure 2:
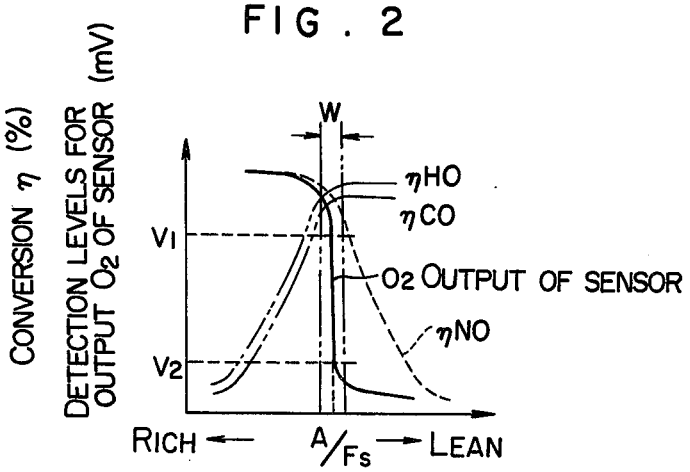
FIG. 2 is a graph showing the conversion rate and the detection levels in relation to the air-fuel ratio.

FIG. 2 shows the conversion rate $\eta$ (%) of the oxidizing catalyst, the output of the $O_2$ sensor and the detection levels of the control circuit in relation to the air-fuel ratio (A/F).

Generally, a ternary catalyst for cleaning exhaust gases of an internal combustion engine by removing the three components of carbon monoxide, hydrocarbons and oxides of nitrogen has its conversion rate $\eta$ maximized near the theoretical air-fuel ratio (A/Fs). Thus, if the air-fuel ratio of fuel-air mixtures supplied by the fuel supply device is regulated in such a manner that the air-fuel ratio is within a certain range (W) in the vicinity of the theoretical air-fuel ratio, the catalyst will show high efficiency with respect to all the aforementioned components, thereby making it possible to simultaneously reduce the amounts of hydrocarbons, carbon monoxide and oxides of nitrogen.

On the other hand, the $O_2$ sensor produces an output which is consistent with the density of oxygen in exhaust gases, its characteristics manifesting sudden changes in the vicinity of the theoretical air-fuel ratio. Thus, if the detection levels are set at $V_1$ on the rich mixture side and at $V_2$ on the lean mixture side, it will be possible to regulate the air-fuel ratio such that the ratio is made to approximate the theoretical air-fuel ratio by controlling the output of the $O_2$ sensor.

Figure 3:
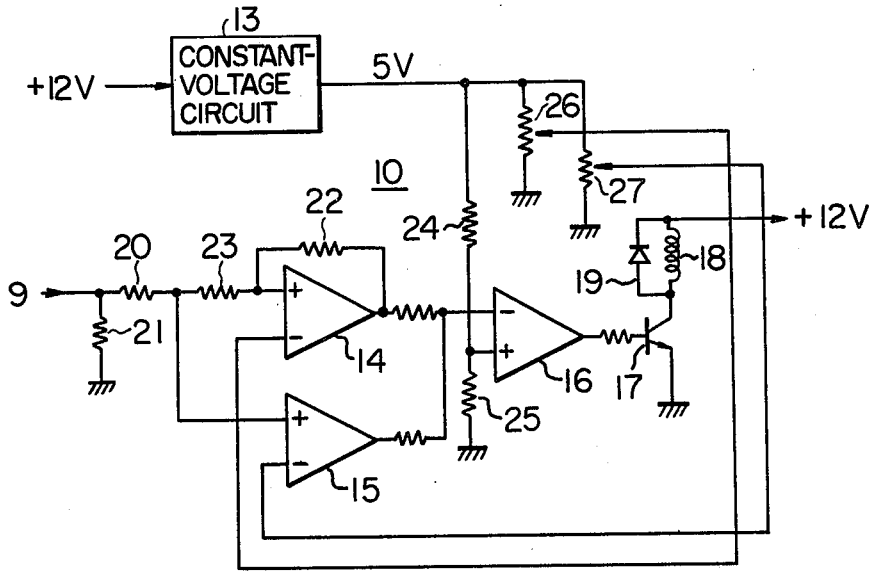
FIG. 3 shows circuit elements arranged in concrete form of the control circuit shown in FIG. 1.

FIG. 3 shows the circuit elements making up the control circuit 10 shown in FIG. 1. The numeral 13 is a known constant-voltage circuit which converts a battery voltage of 12 volts to an operation voltage of 5 volts, 14 a first comparator, 15 a second comparator, 16 an AND gate, 17 an output transistor, 18 a solenoid for the electromagnetic valve 11, and 19 a surge absorbing diode. The numerals 22 and 23 are resistors for determining the hysteresis range, 24 and 25 voltage dividing resistors, and 26 and 27 potentiometers for determining the detection levels $V_1$ and $V_2$.

Ideally, the air-fuel ratio of fuel-air mixtures supplied by the fuel supply device 1 of the apparatus shown in FIG. 1 to the combustion chamber 4 thereof should be near the theoretical air-fuel ratio A/Fs under all operating conditions. However, the air-fuel ratio varies every moment as the engine speeds and the negative pressure in the suction pipe undergo a change every moment.

A variation in the air-fuel ratio causes a change to occur in the output of the exhaust gas detector or $O_2$ sensor as shown in FIG. 2, for example, because the density of the oxygen contained in the exhaust gases also undergoes a change. Meanwhile the control circuit 10 has detection levels represented by the voltages $V_1$ and $V_2$ and produces an output which is related to one of these levels to actuate the electromagnetic valve 11, so that the volume of fuel flow from the fuel supply device or the volume of air which is drawn by suction and which is bypassed can be varied. In this way, the control circuit 10 regulates the air-fuel ratio so that it may remain in a predetermined range including the theoretical air-fuel ratio, irrespective of whether the fuel-air mixture is rich or lean.

Figure 4:
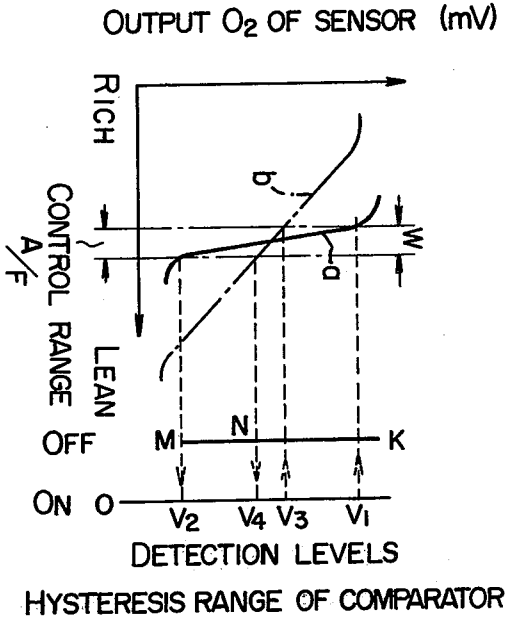
FIG. 4 is a view in explanation of the operation of the circuit shown in FIG. 3.

If it is taken for granted that the output characteristics of the $O_2$ sensor do not show a change with time or that there is no variation in the output characteristics thereof from one $O_2$ sensor to another, then no problem arises, because the air-fuel ratio to be regulated can be kept constant by keeping the detection levels $V_1$ and $V_2$ constant. However, in actual practice the output of the $O_2$ sensor may vary from characteristics *a* to characteristics *b* depending on the quality of the product, or the characteristics *a* may change into the characteristics *b* with time as shown in FIG. 4. Therefore, if the detection levels $V_1$ and $V_2$ are kept constant, the air-fuel ratio to be regulated will naturally deviate from the correct value.

In the air-fuel ratio regulating apparatus according to the invention, the resistors 22 and 23 of a suitable value are selected for the first comparator 14, so that the output of the comparator will have a hysteresis range. By this arrangement, it is possible to keep constant the air-fuel ratio to be regulated, because, when the output characteristics of the $O_2$ sensor is *a*, the detection levels are $V_1$ and $V_2$ and the hysteresis range is O-$V_1$-K-M-$V_2$-O, and, when the output characteristics of the $O_2$ sensor is *b*, the detection levels are $V_3$ and $V_4$ and the hysteresis range is O-$V_3$-K-N-$V_4$-O.

It is the potentiometers 26 and 27 that determine the detection levels $V_1$ to $V_4$, with the potentiometer 26 determining the detection levels $V_1$ and $V_3$ on the rich mixture side and the potentiometer 27 determining the detection levels $V_2$ and $V_4$ on the lean mixture side.

If, for example, the air-fuel ratio decreases and the mixture becomes richer and exceeds the detection level $V_1$ when the output properties of the $O_2$ sensor 9 is *a*, the electromagnetic valve 11 will be turned off to increase the sectional area of the flow of air bleed and restrict the volume of the injected fuel. This causes the mixture to become lean, so that the air-fuel ratio of the mixture can be restored to a desired level. On the other hand, if the air-fuel ratio increases and the mixture becomes leaner and lower than the detection level $V_2$, the electromagnetic valve 11 will be turned on to close the air bleed and increase the volume of the injected fuel to thereby enrich the mixture, so that the air-fuel ratio can be regulated to be within a desired range of values.

Figure 5:
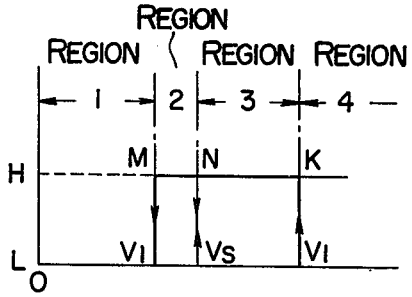
FIG. 5 is a view in explanation of the operation of the comparators shown in FIG. 3.

The hysteresis range of the comparators 14 and 15 will be described in detail. FIG. 5 shows the operation of each comparator in which the operation of the first comparator 14 is indicated by O-$V_1$-K-M-$V_1'$-O and therefore the first comparator 14 has hysteresis characteristics, while the operation of the second comparator 15 is indicated by O-$V_2$-N-$V_s$-O and thus the second comparator 15 has no hysteresis characteristics. The hysteresis characteristics of the first comparator 14 can be expressed by the following formulas:

$$\text{Rise Point } V_1 - K = \frac{V_{p26}(R_{22} + R_{23})}{R_{22}}$$

$$\text{Decay Point } M - V_1 = \frac{V_{p26}(R_{22} + R_{23}) - ER_{23}}{R_{23}}$$

where $R_{22}$ is the value of resistance of resistor 22, $R_{23}$ is the value of resistance of resistor 23, $Vp_{26}$ is the negative input of the comparator 14 or the voltage of the first potentiometer 26, and E(= 5 V) is the voltage of the power source. Thus the hysteresis range $\Delta V$ can be expressed by $\Delta V = V_1 - V_1'$. From this, it will be evident that it is possible to obtain any hysteresis characteristics as desired by adjusting the voltage of the first potentiometer 26.

If the output of the first comparator 14 and the output of the second comparator 15 are supplied as inputs to the AND gate 16, the output of the AND gate is determined by the voltage levels of the zones shown in FIG. 5. After all, the first comparator 14 detects the upper limit (rich mixtures) and the second comparator 15 detects the lower limit (lean mixtures), and the output characteristics thereof have the hysteresis range shown in FIG. 4 and are suitable for two-position operation. In FIG. 5, L denotes a low level and H a high level.

As described hereinabove, in the air-fuel ratio regulating apparatus according to the invention, one component of exhaust gases is detected by an exhaust emission detector and the output of the detector is discriminated by a control circuit having hysteresis characteristics, the output of the control circuit turning on or off an electromagnetic valve so as to automatically regulate the air-fuel ratio of fuel-air mixtures supplied by a fuel supply device to be within a predetermined range. The apparatus offers the great advantage of not being influenced by the output characteristics of the exhaust emission detector.

The apparatus according to the present invention compensates for variations in characteristics from one exhaust emisson detector to another and for deterioration of the detector with time, and enables the detector to perform with the same degree of accuracy regardless of its years of service. The control circuit for accomplishing this is simple in construction, so that an increase in overall cost caused by the provision of the feedback system can be minimized. Thus the air-fuel ratio regulating apparatus according to the invention is particularly suitable for use with motor vehicles which are manufactured on a mass production basis, for the purpose of cleaning exhausts and avoiding the problem of air pollution.

Moreover, since the air-fuel ratio of fuel-air mixtures is regulated by means of the feedback system, the invention enables to reduce the precision with which the carburetor or other fuel control devices are required to be manufactured. This is conductive to increased durability and reliability in performance of various devices, and the production cost of these devices can be greatly reduced.

In the embodiment of the invention described hereinabove, a carburetor has been described as being used as the fuel supply device. It is to be understood, however, that the invention is not limited to the use of a carburetor, and that the invention can achieve the same results with the use of other fuel supply device, such as an electronic fuel injection device.

In the embodiment of the invention described above, the sectional area of the air flow in the air flow in the air bleed is varied in regulating the air-fuel ratio. It is to be understood that the invention is not limited to this process of regulating the air-fuel ratio, and that the air-fuel ratio may be regulated by varying the volume of fuel flow or changing the electric signal which corresponds to the volume of air or fuel flow.

We claim:

1. In an air-fuel ratio regulating apparatus for an internal combustion engine comprising fuel supply means for supplying fuel to suction means of the internal combustion engine, a combustion chamber for burning a fuel-air mixture supplied by said suction means, and detector means for detecting a specific component of exhaust emissions from said combustion chamber, said apparatus being adapted to regulate the amount of fuel supplied by said fuel supply means in accordance with the output of said detector means, the improvement comprising a first comparator having a hysteresis range and a second comparator having no hysteresis and having an operation level whose value is within the hysteresis range of said first comparator, said first and second comparators forming a circuit which receives a supply of output from said detector means for detecting the specific component of the exhaust emissions and which produces an output used for varying the volume of fuel supplied by said fuel supply means.

2. The improvement in an air-fuel ratio regulating apparatus according to claim 1, wherein the outputs of said first comparator and said second comparator are introduced into AND logical means, and an electric signal is supplied to said fuel supply means in accordance with the output of said AND logic means.

3. The improvement in an air-fuel ratio regulating apparatus as claimed in claim 2, further comprising a constant voltage circuit through which a voltage is supplied to each of said first comparator, said second comparator and said AND logic means.

* * * * *